US007246556B1

(12) United States Patent
Stoneberg et al.

(10) Patent No.: US 7,246,556 B1
(45) Date of Patent: Jul. 24, 2007

(54) CASE FOR MULTIPLE STAMP PADS

(75) Inventors: J. Bruce Stoneberg, Oak Brook, IL (US); Simon Leung, Tai Nan St West (HK)

(73) Assignee: Safe-T Products, Inc., Lombard, IL (US)

( * ) Notice: Subject to any disclaimer, the term of this patent is extended or adjusted under 35 U.S.C. 154(b) by 0 days.

(21) Appl. No.: 11/244,849

(22) Filed: Oct. 6, 2005

(51) Int. Cl.
*B41K 1/40* (2006.01)
*E05D 7/00* (2006.01)

(52) U.S. Cl. ..... 101/333; 16/224; 16/365; 220/4.22; 220/531; 220/840

(58) Field of Classification Search ..... None
See application file for complete search history.

(56) References Cited

U.S. PATENT DOCUMENTS 1,518,756 A * 12/1924 Rapley et al. ..... 118/264
1,598,538 A * 8/1926 Mann ..... 118/269
3,061,137 A * 10/1962 Svoboda et al. ..... 220/840
3,077,282 A * 2/1963 Eggers ..... 220/840
3,179,281 A * 4/1965 Svoboda et al. ..... 220/840
4,031,853 A * 6/1977 Conrad ..... 118/264
5,505,130 A 4/1996 Winston
5,601,867 A * 2/1997 Riedl et al. ..... 427/1
6,726,004 B2 4/2004 Watson
6,877,425 B2 4/2005 Lynton
2002/0162842 A1* 11/2002 Pangerc et al. ..... 220/524

OTHER PUBLICATIONS

"Two-Color Felt Stamp Pad," Manufacturer: Garvey, Product #:COS-090468, http://hometownstores.com, (Jul. 25, 2005).

* cited by examiner

*Primary Examiner*—Daniel J. Colilla
*Assistant Examiner*—Jill E. Culler
(74) *Attorney, Agent, or Firm*—Drinker Biddle & Reath LLP

(57) ABSTRACT

A case for multiple stamp pads is provided. One embodiment of the case includes a first housing portion for retaining a first stamp pad, a second housing portion for retaining a second stamp pad, a hinge connecting the first and second housing portions for movement between a closed configuration where the first and second stamp pads are facing each other and sealed within the first and second housing portions and an open configuration where the first and second stamp pads are exposed for use, and a divider separating the first and second stamp pads in the closed configuration and swingably covering one of the first and second stamp pads in the open configuration.

19 Claims, 3 Drawing Sheets

CASE FOR MULTIPLE STAMP PADS

FIELD OF THE INVENTION

This invention generally pertains to a container, and more particularly to a clamshell-type case including an internal hinged divider for separating multiple stamp pads.

BACKGROUND OF THE INVENTION

Stamp pads, also commonly known as ink pads and inking pads, include an absorbent material, for example, sponge, fabric (e.g., felt, microfiber, etc.) or the like that is saturated with an ink for marking an object such as paper via a conveyance such as a rubber stamp. The ink may be of the indelible/permanent type, a water-based washable type, or other type of ink known in the art. The absorbent material is disposed in a formed or molded case that is generally made of metal or plastic. The case typically includes a base portion that retains the absorbent material and a lid or cover that is coupled with the base portion. The lid moves to expose the absorbent material for use and seal the absorbent material within the case during periods of non-use, thereby preventing the ink from evaporating out of the absorbent material and from accidentally transferring to an object. In some instances, the lid is attachable and removable from the base portion (e.g., via a friction fit), but more commonly the lid is hinge-connected with the base portion to prevent a user from misplacing or losing the lid.

Conventionally, only one ink pad is provided in a case. Typically, the ink pad has a single color ink, for example, black, red or blue for stamping a single-colored mark. In other instances, the ink pad is divided or separated into a plurality of small, adjacent, co-planar pads (e.g., a matrix), each of which has a different colored ink to use with small stamps for stamping a single-colored mark or for use with large stamps to stamp a multi-colored mark. Depending on the stamps and the ink colors desired or needed by an individual for a particular project (e.g., scrap-booking), the individual may need to have available several cases of stamp pads open simultaneously. One can appreciate that the use of such cases with hinge-connected lids is somewhat disadvantageous since the lid cannot be pivoted more than 180 degrees to be positioned underneath the base portion and therefore occupies space on the work surface that could be used otherwise.

In view of the foregoing, an improved case for multiple stamp pads would be welcomed.

BRIEF SUMMARY OF THE INVENTION

A case for multiple stamp pads is provided. One embodiment of the case includes a first housing portion for retaining a first stamp pad, a second housing portion for retaining a second stamp pad, a hinge connecting the first and second housing portions for movement between a closed configuration where the first and second stamp pads are facing each other and sealed within the first and second housing portions and an open configuration where the first and second stamp pads are exposed for use, and a divider separating the first and second stamp pads in the closed configuration and swingably covering one of the first and second stamp pads in the open configuration.

DETAILED DESCRIPTION OF THE EMBODIMENTS

Figure 1:
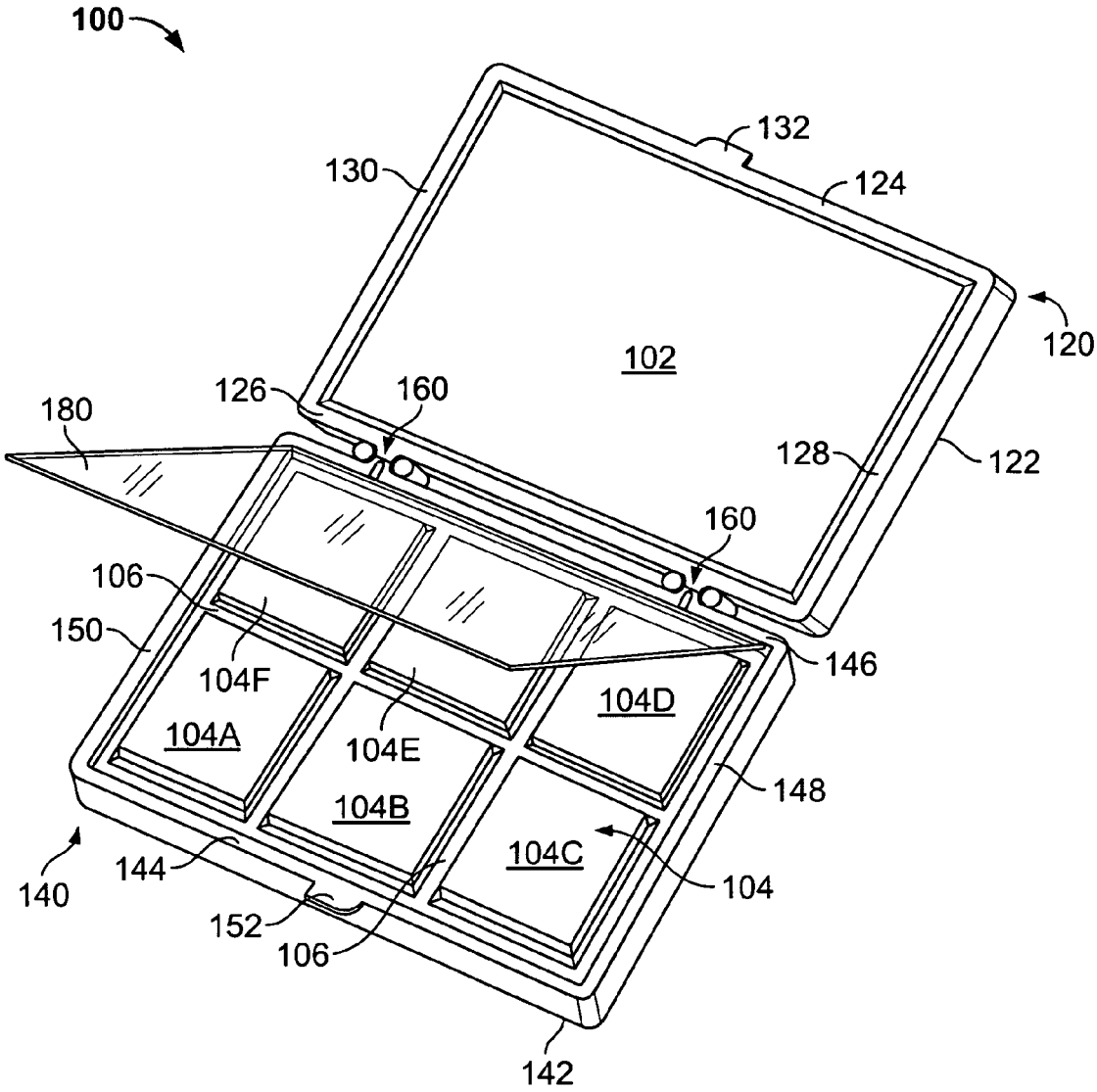
FIG. 1 is a perspective view of an embodiment of a stamp pad case in the open configuration.
Figure 4:
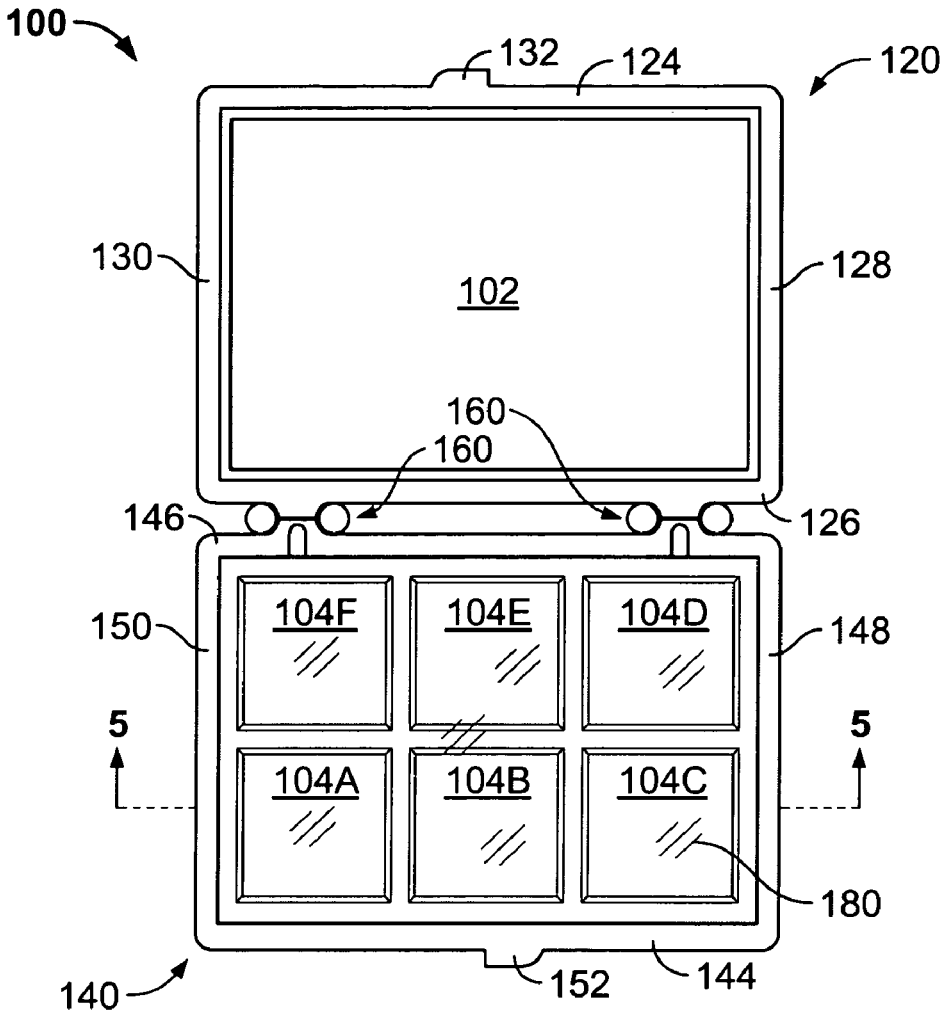
FIG. 4 is a top plan view of the embodiment of FIG. 1.

Referring now to the Figures, a case for multiple stamp pads is described. As shown in FIGS. 1 and 4, the case 100 is configured to retain two stamp pads 102, 104 in separate housing portions 120, 140, respectively. As known in the art, the stamp pads 102, 104 comprise an absorbent material and retain a viscous ink for transferring to an object via a rubber stamp or the like. The ink may be any type of ink known in the art (e.g., water-soluble or indelible), but preferably the ink is washable and nontoxic. As further shown, one or both of the stamp pads 102, 104 may be separated into two or more areas of different colors. As illustrated, stamp pad 104 includes six areas 104A-104F, but fewer or additional areas may be provided. In an example, stamp pad 102 may have a single color ink such as black, whereas stamp pad 104 comprises a matrix of areas 104A-104F, each of which has a different color ink (e.g., red, yellow, magenta, orange, blue and green respectively). As shown, the areas 104A-104F are separated by partitions 106 such as plastic webbing to prevent mixing of the various colors of areas 104A-104F.

As shown in FIG. 1, the housing portions 120, 140 are generally rectangular in shape for retaining rectangular-shaped stamp pads 102, 104, but the housing portions 120, 140 may be configured otherwise to retain stamp pads having other shapes, for example, circular stamp pads, etc. The housing portions 120, 140 may be formed or molded of a plastic or metal material, but other suitable materials may be employed. The first housing portion 120 includes a planar base 122 and a perimeter wall depending perpendicularly upwardly therefrom, the perimeter wall comprising opposing front and rear walls 124, 126 that extend respectively across the front and rear sides of the planar base 122 and opposing right and left walls 128, 130 respectively that extend between the front and rear walls 124, 126. The second housing portion 140 includes a planar base 142 and a perimeter wall depending perpendicularly upwardly therefrom, the perimeter wall comprising opposing front and rear walls 144, 146 that extend respectively across the front and rear sides of the planar base 142 and opposing right and left walls 148, 150 respectively that extend between the front and rear walls 144, 146. Although the housing portions 120, 140 are illustrated to be substantially similar, the case 100 should not be limited as such. In fact, the perimeter wall of each housing portion may have a different height to, for example, correspond with a height of a stamp pad that is retained therein or help ensure that both portions 120, 140 lay flat simultaneously on a work surface.

Figure 2:
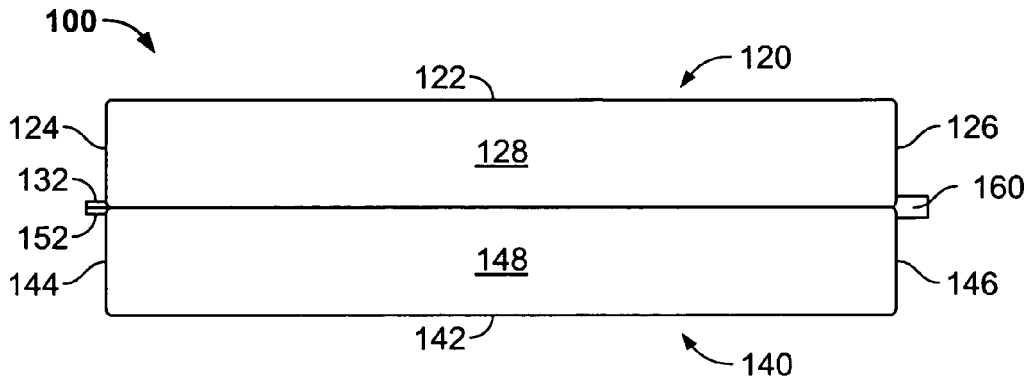
FIG. 2 is a side elevation view of the embodiment of FIG. 1 in the closed configuration.
Figure 3:
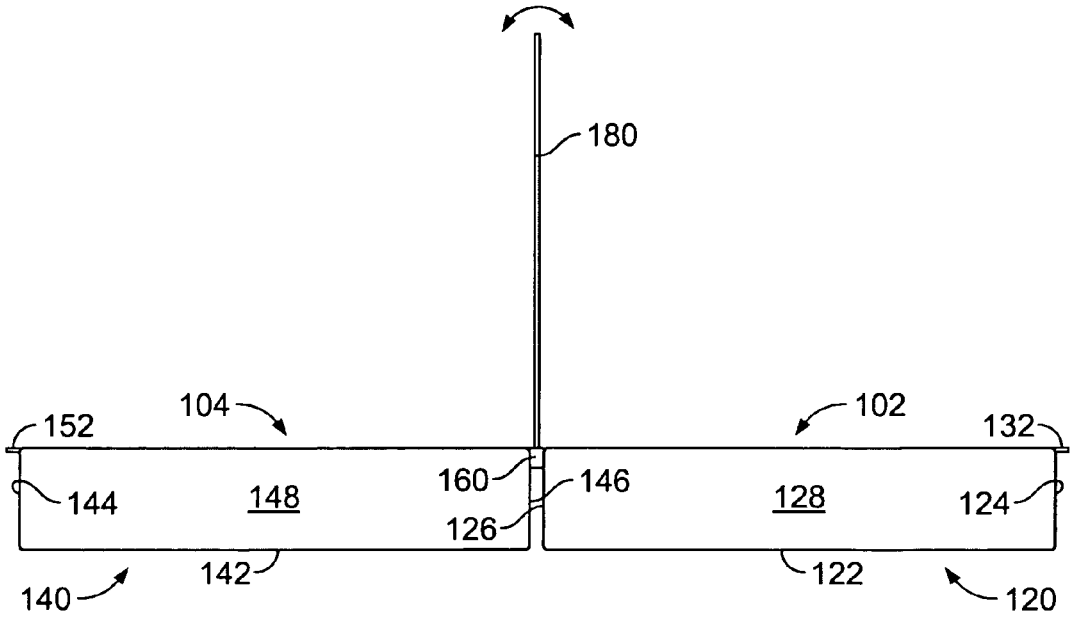
FIG. 3 is a side elevation view of the embodiment of FIG. 1.

The rear walls 126, 146 of the housing portions 120, 140 are coupled together for relative movement between a closed configuration as shown in FIG. 2 and an open configuration as shown in FIGS. 1, 3 and 4. As shown in FIG. 1, the rear walls 126, 146 are coupled together by hinges 160. Although two hinges 160 are shown, fewer or additional hinges may be provided. Furthermore, although the hinges 160 are illustrated as ball and knuckle-type hinges, the hinges 160 may be other types of suitable hinges known in the art such as, for example, a living hinge, a piano hinge, etc. As further shown in FIG. 1, the front walls 124, 144 each include a tongue 132, 152, respectively that frictionally mate to form a closure that maintains the portions 120, 140 in the closed configuration so that the case 100 can be stored, carried and the like. Further, tongues 132, 152 may help a user to pry open the case 100 by moving the tongues 132, 152 in opposite directions. Of course other closures known in the art may be suitable as well, for example, a latch, a catch, a hook and eye, etc.

Referring now to FIGS. 1 and 3-5, the illustrated case 100 includes a divider 180. The divider 180 is planar and generally rectangular to substantially cover one of the stamp pads 102, 104 when the case 100 is in the open configuration. The divider 180 may be made of a transparent or translucent material such as plastic so that a stamp pad 102, 104 thereunder is visible. Furthermore, the divider 180 may be somewhat smaller than the planar bases 122, 142 so that the divider 180 is completely disposed in the housing portions 120, 140 when the case 100 is in the closed configuration. As can be appreciated from FIG. 3, when the case 100 is in the open configuration, the divider 180 is configured to swingably move through an angle of approximately 180 degrees so as to selectively cover one of the ink pads 102, 104. Additionally, as shown in FIG. 3, the divider 180 may be configured to remain in a generally vertical orientation so that both of the stamp pads 102, 104 are exposed for use. Although the illustrated case 100 includes a single divider 180, other embodiments may include a divider that is split along one or more lines running from the rear of the case to the front of the case to provide two or more dividers that are disposed in a side-by-side arrangement. In this way, access to an entire stamp pad or a portion thereof may be restricted as desired. For example, referring to FIG. 1, it can be appreciated that divider 180 may be split along two lines that are co-linear and co-extensive with the two partitions 106 running between rear wall 146 and front wall 144. Such a configuration of the divider 180 would allow a user to selectively access one or more pairs of areas 104A with 104F, 104B with 104E, and 104C with 104D. Of course, the divider 180 could be split otherwise if the areas of stamp pad 104 were configured otherwise.

In some embodiments, the divider 180 may be movably coupled with a portion of one of the housing portions 120, 140, for example a portion of one of the housing portions 120, 140 proximate the hinge 160. As shown in FIGS. 1 and 4, the divider 180 is coupled with the rear wall 146 of housing portion 140, but alternatively, the divider could be coupled with the rear wall 126 of housing portion 120. In other embodiments, the divider 180 may be movably coupled with the hinge 160 as illustrated in FIG. 3. For example, when the hinge 160 that is employed for coupling the housing portions 120, 140 is the illustrated ball and knuckle hinge, the knuckle may include a socket into which a ball on an edge of the divider 180 is disposed. Indeed, other methods for coupling the divider 180 to the housing portions 120, 140 or the hinge 160 may be employed as well.

Figure 5:
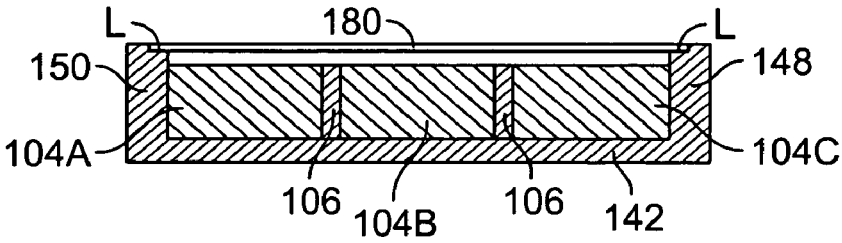
FIG. 5 is an elevation view illustrating a section of the embodiment of FIG. 1.

As shown in FIG. 1, the stamp pads 102, 104 of some embodiments may be recessed in the housing portions 120, 140 or otherwise configured to be lower than an upper surface of the perimeter wall. In such embodiments, the coupling of the divider 180 to the housing portions 120, 140 or the hinge 160 may include stops or the like that prevent the divider 180 from pivoting lower than the upper surfaces of the perimeter walls so that the divider 180 does not contact the stamp pads 102, 104 and become inked. In other embodiments, the perimeter wall of one or both of the housing portions 120, 140 may include a recessed ledge on which the divider 180 rests. As shown in FIG. 5 (which illustrates a cross-sectional view of the stamp pad case 100 of FIG. 4), the top surface of each of the side walls 148, 150 has a stepped profile due to an inset, recessed ledge L. In this embodiment, the side edges of the divider 180 are supported on the ledges L as shown to prevent the divider 180 from moving further downward and contacting the stamp pads thereunder. As further shown in FIG. 5, in embodiments including a matrix of stamp pads (e.g., pads 104A-104F of FIGS. 1 and 4), the partitions 106 may be configured to extend upwardly past the top surface of the stamp pads to cooperate with or replace the ledges L for supporting the divider 180. As can be appreciated, each of the housing portions 120, 140 may include a perimeter wall configured with a ledge L so that the divider is sandwiched therebetween in the closed configuration to substantially immobilize the divider 180.

Various exemplary embodiments of the invention are described herein. Variations of those embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A stamp pad case comprising:

a first housing portion including a first cavity for retaining a first stamp pad;

a second housing portion including a second cavity for retaining a second stamp pad;

a hinge connecting the first and second housing portions for movement between a closed configuration where the first and second stamp pads are facing each other and sealed within the first and second housing portions and an open configuration where the first and second stamp pads are exposed for use; and a swingable divider for separating the first and second stamp pads in the closed configuration and covering one of the first and second stamp pads in the open configuration, wherein at least one of the first cavity and the second cavity is defined by a planar base and a perimeter wall extending generally perpendicularly from the planar base and including a top surface having a depressed ledge, wherein the swingable divider is generally planar and the depressed ledge is configured to support the swingable divider above a respective one of the first stamp pad and the second stamp pad.

2. The stamp pad case of claim 1 wherein the hinge comprises a living hinge.

3. The stamp pad case of claim 1 wherein the swingable divider is connected to one of the first and second housing portions proximate the hinge.

4. The stamp pad case of claim 3 wherein the swingable divider is connected to one of the first and second housing portions by a living hinge.

5. The stamp pad case of claim 1 wherein the hinge comprises:

a knuckle part on one of the first and second housing portions; and spaced-apart ball parts on the other one of the first and second housing portions, the spaced-apart ball parts configured for gripping the knuckle part and for pivotally rotating thereon.

6. The stamp pad case of claim 5 wherein the swingable divider is connected with the knuckle part.

7. The stamp pad case of claim 1 wherein the top surface includes a socket proximate the hinge and the swingable divider further comprises a ball that is disposed in the socket.

8. A stamp pad case comprising:

a first housing portion including a first cavity for retaining a first stamp pad;

a second housing portion including a second cavity for retaining a second stamp pad;

a hinge connecting the first and second housing portions for movement between a closed configuration where the first and second stamp pads are facing each other and sealed within the first and second housing portions and an open configuration where the first and second stamp pads are exposed for use, the hinge including a knuckle part on one of the first and second housing portions, and spaced-apart ball parts on the other one of the first and second housing portions, the spaced-apart ball parts being configured for gripping the knuckle part and for pivotally rotating thereon; and a swingable divider for separating the first and second stamp pads in the closed configuration and covering one of the first and second stamp pads in the open configuration, wherein the swingable divider is connected with the knuckle part.

9. The stamp pad case of claim 8 wherein the first housing portion comprises:

a planar base; and a perimeter wall extending perpendicularly from the planar base and including a top surface having a depressed ledge, wherein the swingable divider is planar and the depressed ledge is configured to support the swingable divider above the first stamp pad.

10. The stamp pad case of claim 9 wherein the second housing portion comprises:

a second planar base; and a second perimeter wall extending perpendicularly from the second planar base and including a second top surface having a second depressed ledge that is configured to support the swingable divider above the second stamp pad, wherein the depressed ledges are configured to sandwich and substantially immobilize the swingable divider in the closed configuration.

11. The stamp pad case of claim 10 wherein one of the top surfaces includes a socket proximate the hinge and the swingable divider further comprises a ball that is disposed in the socket.

12. The stamp pad case of claim 8 wherein the second housing portion comprises:

a planar base; and a perimeter wall extending perpendicularly from the planar base and including a top surface having a depressed ledge, wherein the swingable divider is planar and the depressed ledge is configured to support the swingable divider above the second stamp pad.

13. A case for multiple stamp pads, the case comprising:

a first housing portion for retaining a first stamp pad, the first housing portion including a planar base, a wall surrounding the perimeter of the first stamp pad and extending a predetermined distance above an upper surface of the first stamp pad;

a second housing portion for retaining a second stamp pad, the second housing portion including a planar base, a wall surrounding the perimeter of the second stamp pad and extending a predetermined distance above an upper surface of the second stamp pad;

a hinge connecting the first and second housing portions for movement between a closed configuration where the first and second stamp pads are facing each other and sealed within the first and second housing portions and an open configuration where the first and second stamp pads are side by side and exposed for use; and a planar divider separating the first and second stamp pads in the closed configuration and swingably covering one of the first and second stamp pads in the open configuration, wherein at least one wall of the first and second housing portions includes a top surface having a depressed ledge that is configured to support the planar divider.

14. The case of claim 13 wherein the hinge comprises a living hinge.

15. The case of claim 13 wherein the planar divider is connected to a portion of the wall of one of the first and second housing portions that is proximate the hinge.

16. The case of claim 15 wherein the planar divider is connected to one of the first and second housing portions by a living hinge.

17. The case of claim 13 wherein the hinge comprises:

a knuckle part on the wall of one of the first and second housing portions; and spaced-apart ball parts on the wall of the other one of the first and second housing portions, the spaced-apart ball parts configured for gripping the knuckle part and for pivotally rotating thereon.

18. The case of claim 17 wherein the planar divider is connected with the knuckle part.

19. The case of claim 18 wherein the knuckle comprises a socket and the planar divider comprises a ball that is disposed in the socket.

* * * * *